US005485881A

United States Patent [19]

Toon et al.

[11] Patent Number: 5,485,881

[45] Date of Patent: Jan. 23, 1996

[54] GROUNDWATER SAMPLER

[75] Inventors: Donald A. Toon, Burlington, Canada; Per H. Nielsen, Copenhagen; Bent Skov, Hedehusene, both of Denmark

[73] Assignee: Solinst Canada Limited, Georgetown, Canada

[21] Appl. No.: 237,893

[22] Filed: May 4, 1994

[30] Foreign Application Priority Data

May 4, 1993 [GB] United Kingdom ..... 9309205

[51] Int. Cl.[6] ..... E21B 49/08

[52] U.S. Cl. ..... 166/165; 73/864.65; 166/332.4; 175/20

[58] Field of Search ..... 166/334, 332, 166/163, 165, 166, 264, 318, 164; 73/864.65; 175/59, 20

[56] References Cited

U.S. PATENT DOCUMENTS

| | | | |
|---|---|---|---|
| 2,384,090 | 9/1945 | Hartsell | 166/163 X |
| 2,751,020 | 6/1956 | Johnston | 166/334 X |
| 3,163,225 | 12/1964 | Perkins | 166/334 X |
| 4,438,654 | 3/1984 | Torstensson | 166/264 X |
| 4,612,984 | 9/1986 | Crawford | 166/77 |
| 5,343,968 | 9/1994 | Glowka | 175/231 |

FOREIGN PATENT DOCUMENTS

| | | | |
|---|---|---|---|
| 252249 | 10/1970 | U.S.S.R. | 166/264 |
| 7519079 | 7/1980 | U.S.S.R. | 175/59 |

*Primary Examiner*—Hoang C. Dang
*Attorney, Agent, or Firm*—Anthony Asquith & Co.

[57] ABSTRACT

For extracting samples of groundwater from a borehole. A down-hole fixture has a check-valve positioned at the foot of the borehole. A sampler is lowered down into the borehole. Pushing down on the sampler causes a stem on the sampler to unseat the check-valve, communicating groundwater with the sampler. A plastic tube running from the sampler to the surface transmits the push from the surface, required to operate the down-hole valve.

11 Claims, 3 Drawing Sheets

GROUNDWATER SAMPLER

This invention relates to the extraction of water samples from a bore-hole in the ground.

The invention makes use of a down-hole fixture, in which a check-valve is provided, usually below the level of the water table. The valve normally seals off water below the valve from travelling up the hole whereby the valve, when closed, is under pressure.

A sample-container may be inserted in the bore-hole. In a preferred form, a nose is provided on the sample container, and pressing the nose against the in-hole check-valve is effective to unseat the valve, and admit water into the sample chamber. The sample container is then withdrawn from the hole, whereupon the valve once more closes.

The invention may be used in cases where samples of water are to be brought to the surface periodically over a period of time, from a fixed location that lies below the water table. Such samples often need to be drawn off in a very controlled manner, both as regards the volume of the sample, and as regards taking the water from exactly below the valve.

It is recognised that it is possible to press the nose on the sampler hard enough, from the surface, for the nose to enter the in-ground valve, to seal itself against the valve, then to unseat the valve, and then to resist the pressure of the water as the water passes through the valve into the sampler. It has been found that a down-hole lock is not required to hold the sampler in place when the valve is open, and the sampler is exposed to water pressure: the sampler can be held down by pushing it from above.

The invention lies in the association of a down-hole valve that can be unseated mechanically, and a structure that can be forced down the hole to unseat the valve.

DETAILED DESCRIPTION OF PREFERRED EMBODIMENT

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
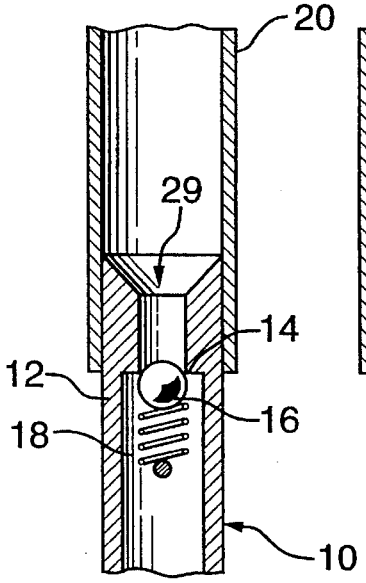
FIG. 1 is a cross-section of a hole in the ground, showing a port in place in the ground, as a permanent fixture.
Figure 2:
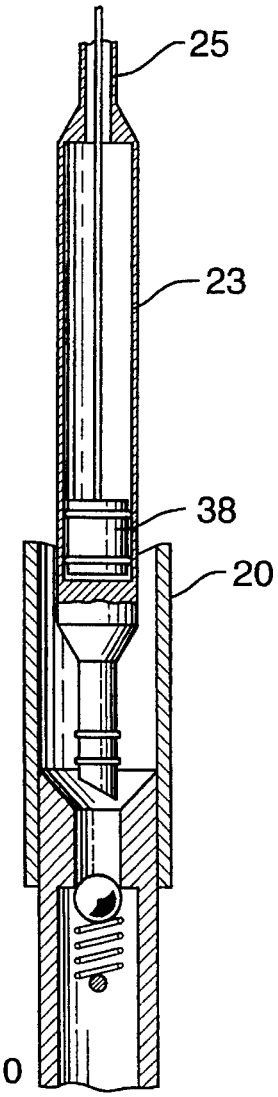
FIG. 2 is the same section as FIG. 1, but shows a sampler being lowered down the hole, and approaching the port.
Figure 3:
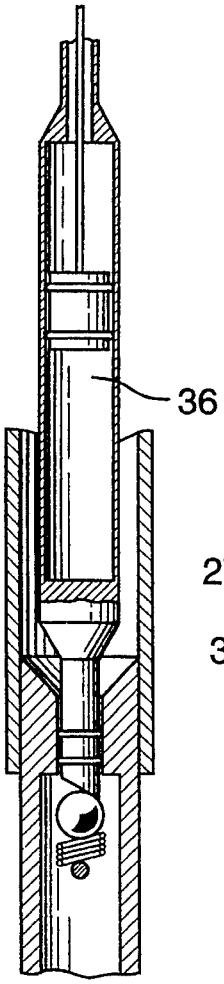
FIG. 3 is the same section as FIG. 1, but shows the sampler in position for receiving a sample from the port.
Figure 4:
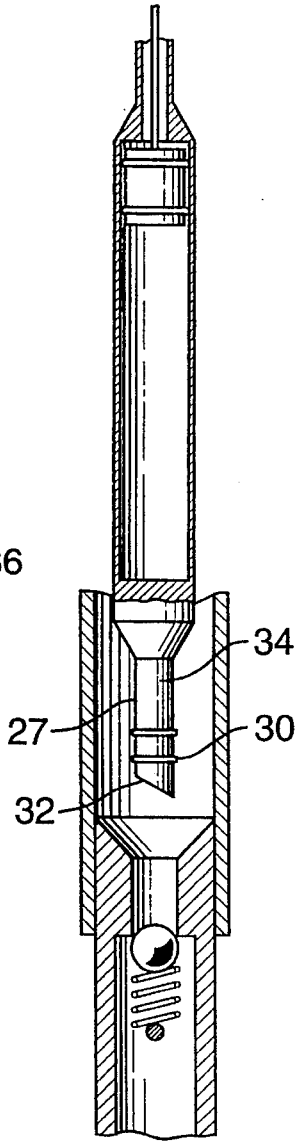
FIG. 4 is the same section as FIG. 1, but shows the sampler being withdrawn.

In FIG. 1, a sampling port 10 is installed in the ground as a permanent fixture. The port 10 comprises a housing 12, in which is formed a valve seating 14. A valve member in the form of a ball 16 resides in the seating, and is held in place there-against by means of a spring 18.

The housing 12 is attached to a guide case 20, which extends upwards from the housing towards the ground surface, and which in fact protrudes above the ground surface. The guide case 20 comprises a length of plastic tubing, having an internal diameter of about 20 mm. The guide case 20 is attached to the housing 12 by means of a suitable circumferential clamp.

The guide case 20, the housing 12, and the valve member 16 remain in the ground:. When it is desired to take a sample, a sampler is lowered down the hole. The sampler comprises a body 23, which is suspended on a sampler line 25.

The body 23 is formed at its bottom end with a slender tube or nose 27. The nose 27 is dimensioned to enter into and to pass down inside a lead-in hole 29 formed in the housing 12. O-rings 30 reside in grooves in the nose 27, and seal the nose against the lead-in hole 29.

The dimensions of the nose 27 and lead-in hole 29 are such that the O-rings 30 are sealed into the lead-in hole before the tip 32 of the nose touches the ball 16. When the nose has been inserted so far into the lead-in hole that the nose unseats the ball, water under pressure from inside the port can now flow up past the valve seat; the water enters the passage 34 through the nose 27, and passes into the chamber 36 inside the body 23.

Inside the body 23 is a floating piston 38. As water enters the chamber 36, the piston rises up the chamber. The piston rises because the water is under pressure and/or because a vacuum is applied to the sampler line 25 from the surface.

When the sample of water has filled the chamber 36, the sampler is withdrawn, by using the sampler line 25 to pull the body up. As the sampler is withdrawn, the valve member 16 once more rests against the valve seat.

As the sampler is withdrawn, the sample does not fall out of the chamber because the passage 34 in the nose 27 is very narrow. The passage is narrow enough, and long enough, that surface tension between the passage walls and the water within is enough to retain the water. Suction can be maintained in the sampler line, above the piston, as the sampler is withdrawn, to assist in preventing the sample falling out.

A key factor in the operation of the apparatus as described is that the sampler line 25 is used as the vehicle for physically pushing the nose 27 into the lead-in hole 29. The force of the push is applied, of course, at the surface, the force being transmitted down the line 25. The line 25 is made of plastic tubing, and is able to transmit the force only because it is contained within the guide case 20. If the line 25 were not contained, it would simply buckle. As it is, however, sufficient force can be transmitted down the line 25 to enable the technician at the surface to force the nose 27 into the lead-in hole 29 against the friction of the O-rings 30, and other resistances, arid to unseat the valve member 16. In fact, it has been found that the force can be transmitted with excellent sensitivity, whereby the technician can sense when each stage of the insertion procedure is starting, and how it is proceeding.

The line 25 tends to bend somewhat when the force is being transmitted along it, but the amount of bending is quite small, being contained by the guide case: the outer diameter of the line is 15 mm, within the 20 mm internal diameter of the guide case 20. Incidentally, it is often difficult to ensure that the guide case, when installed, is completely straight; but the line 25 can still be pushed through the guide case even if the case should have been installed in the ground with a (slight) bend, kink, or curvature.

It is required that the nose 27 must enter the lead-in hole 29 cleanly, centrally, and square-on. To assist in locating the nose, the sampler body 23 is formed with an outside diameter which, although loose enough to travel freely up and down the guide case 20, is long enough and wide enough to ensure that the nose 27 lines up with the lead-in hole.

The components are made from a material about which there must be no suspicion that the material might taint the water sample. For the components requiring machining, stainless steel or a hard plastic such as PVC are suitable.

Figure 5:
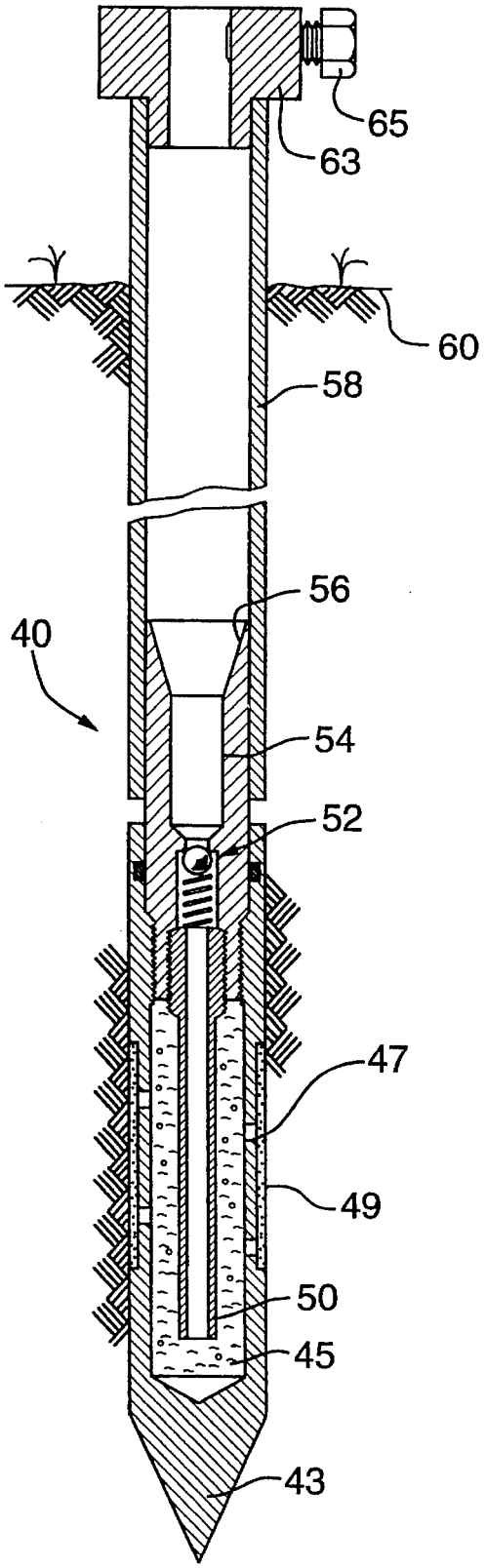
FIG. 5 is a cross-section of a down-hole fixture.

FIG. 5 shows a variation of down-hole fixture, in more detail. The fixture 40 includes a body 43 which defines a reservoir 45. Water seeps through holes 47, and a filter 49, and collects in the reservoir 45. The fixture includes a pick-up tube 50, through which the water may pass, above which lies a spring-loaded ball-type check-valve 52.

Above the check-valve 52, the fixture 40 is formed with a long plain-cylindrical bore 54, which opens into a trumpet 56. The fixture 40 is secured to a conduit 58, which extends to the ground surface 60. The conduit may be of metal, and be so constituted that the fixture can be hammered into the ground, via the conduit, using a jack-hammer. Or, as shown here, the conduit 58 may be of plastic tubing, which is inserted into place in the ground down the centre of a hollow-stem auger. Other ways of placing the fixture and conduit in the ground may also be used.

At the ground surface, the conduit 58 terminates with a collar 63, which is provided with a clamp in the form of screw 65.

Figure 6:
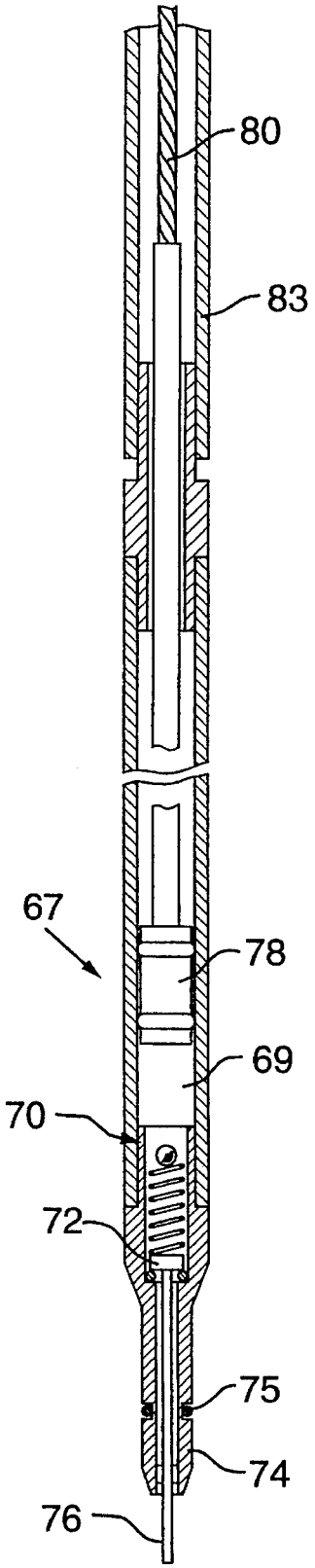
FIG. 6 is a cross-section of a sample-collection container, which complements the fixture of FIG. 5.

FIG. 6 is a cross-section of the sample container structure 67 which is lowered into the bore-hole. The structure 67 includes a chamber 69 for containing the sample of groundwater. At the lower end of the chamber is a check-valve 70. This comprises a spring-biassed valve member 72, which seals against a rubber seal located in the body of the structure 67.

The lower end of the body of the structure 67 is formed with a reduced-diameter nose 74. The valve member 72 is formed with a stem 76, which extends downwards through a bore in the nose 74. The stem 76 protrudes below the nose 74. Upward pressure on the stem 76 results in upward movement of the stem, against the biassing of the spring, and consequent unseating of the valve member 72 from the rubber seal.

The nose 74 carries an O-ring seal 75.

The walls of the chamber 69 are suitable for receiving a piston 78, which is arranged for up/down sealed movement in the chamber. The piston 78 is fixed to a piston rod, to which is swaged or crimped a wire-cable 80. The cable 80 extends up to the ground surface 60. A plastic tube 83 is fixed to the sample container structure, and also extends to the surface. The cable 80 runs inside the tube 83.

In use of the system as shown in FIGS. 5 and 6, the technician lowers the sample container structure down into the borehole. The structure reaches the down-hole fixture, and, as the technician continues to press down on the structure 67 (by pressing down on the plastic tube 83), the nose 74 enters the trumpet 56, and passes into the bore 54. Under continued downward pressure, the seal 75 in the nose 74 also enters the bore 54, thereby creating a seal between the down-hole fixture and the sample container.

The seal between the nose 74 and the bore 54 having been established, the technician continues to press the structure 67 downwards. The stem 76 now contacts the ball of the check-valve 52, and pushes the ball downwards, thus opening the check-valve. Under continued downward pushing, the ball bottoms against its spring, causing the stem 76 to move upwards relative to the nose 74, thus unseating the valve member 72.

During this operation, it is preferred that the check-valve 52 in the down-hole fixture should be unseated before the check-valve 70 in the sample-container structure. However, the order in which the check-valves become unseated is not too important. The order depends on the relative strengths of the springs in the check-valves.

Once the sample-container structure has been pressed down as far as it will go, the seal is established, and both check-valves are open, the groundwater contained in the reservoir 45 starts to flow into the chamber 69. It is usually desired that the water enter the chamber at a slow rate, so that the pressure at which the groundwater has resided underground is not lost. (If the pressure on the sample were to be reduced, gases dissolved in the water might tend to come out of solution, which could lead to an error in the analysis of the sample.)

In some cases, the chamber can be left to fill itself in its own time, on the basis that the in-ground pressure is sufficient to force the piston 78 up the chamber 69. In other cases, the cable 80 may be used to assist in drawing up the piston, more or less slowly as required for a particular sample.

In each case, the sample container structure 67 should be held down firmly, against the tendency of the pressure of the sample to urge the structure to rise. Sometimes, the technician may wish to leave the apparatus while filling is taking place. In that case, he can use the screw clamp 65 to lock the plastic tube 83 to the conduit 58.

The technician can tell when the chamber 69 is filled, because a corresponding length of the cable 80 will have emerged from the tube 83. Once the sample is collected, the screw clamp 65 is released, and the sample container structure is raised. The two check valves—on the down-hole fixture and on the sample container structure—automatically close themselves as the structure is pulled clear of the fixture.

The sample container structure is withdrawn from the borehole, and transferred to the laboratory for analysis. It will be understood that, during shipping and storage, the sample is perfectly sealed in the chamber 69, whereby neither can ingredients be lost, nor can outside materials be admitted. The chamber 69 is opaque (some materials that might be in the sample degrade upon exposure to light).

It may be preferred in some cases to keep the sample, during storage, at a constant volume, in which case the piston is simply locked in place. In other cases, it may be preferred to store the sample at a constant pressure, in which case a container of a gas under a suitable pressure may be connected above the piston. When the time comes for the sample to be removed from the chamber for the analysis, again the arrangement of the chamber, with its check-valve, the piston, etc, give rise to flexibility as to how the sample is to be transferred to the spectrometer or other analysis apparatus.

When the sample container structure is being lowered and raised in the borehole or conduit it is important that the structure be loose and clear within the conduit. It would not do for the structure to jam or snag in the conduit: although a downward force can be exerted on the structure from the surface, that is not to say that the structure can be pushed past jams and snags. Again it should be mentioned that the bore-hole might not be quite straight.

Even though the fit of the structure in the conduit therefore has to be loose, the designer cannot, if the seal 75 is to be relied upon, allow the stem 76 to be loose in the bore 54. Therefore, the trumpet 56, and the rest of the physical shapes and sizes of the components, should be such as to pick up and guide the nose 74 into the bore 54, even though same might lie in an offset or non-co-axial condition.

Similarly, the nose and bore should be long enough, as to their length of relative engagement, that the nose is physically well established in, and guided by, the bore before the seal starts to enter the bore, and then that the seal itself is well established in the bore before the check-valves start to be pushed open.

Figure 7:
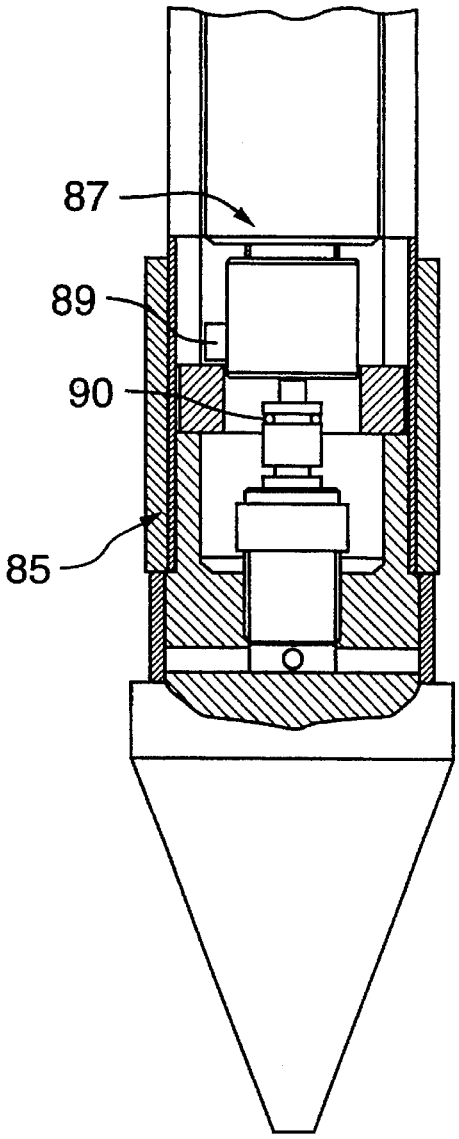
FIG. 7 is a cross-section of another arrangement of down-hole fixture.

FIG. 7 shows another manner of arranging the interaction between the down-hole fixture 85 and the sample container structure 87. In FIG. 7, the bottom end of the structure 87 is provided with a radial peg 89. During assembly, the peg 89 passes down a slot in the body of the down-hole fixture 85. The chamber body is then turned (by twisting from the ground surface) whereby the peg becomes locked by bayonet action. Thus, the need for the screw clamp as in FIG. 5 is avoided, if the sample container structure should have to be left in place for a long period.

As shown in FIG. 7, the O-ring 90 which is to seal the downhole fixture 85 to the sample-container structure 87, is located in the down-hole fixture. It may be preferred to locate the O-ring in the sample-container structure 87, where its condition can be kept under regular check.

It should be mentioned that, when the sample container structure is not present, any dirt falling into the borehole from the surface would very likely settle on the ball of the check valve 52, where it could affect operation, and could get into and contaminate the sample. Therefore, the technician must be scrupulous about excluding dirt from the borehole. It might be possible, if dirt did fall in, to flush it out, but that must be regarded as very much a failure of the required standards of cleanliness.

Figure 8:
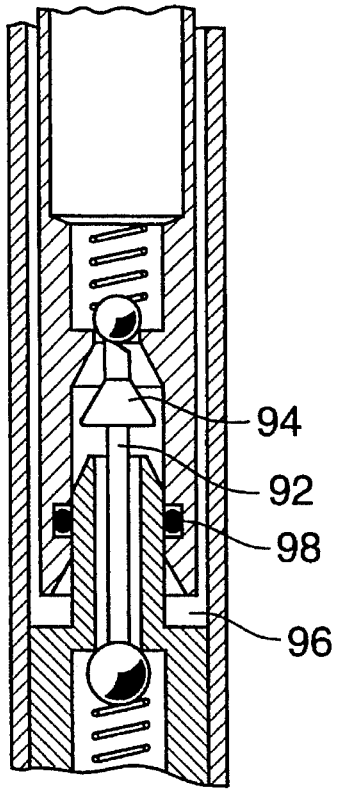
FIG. 8 is a cross-section of a further arrangement of down-hole fixture.

FIG. 8 shows another manner of arranging the interaction between the down-hole fixture and the sample container structure. Here, the stem 92 that operates the check-valves is a component of the down-hole fixture. The stem includes a shroud 94 which serves to deflect dirt falling from above away from the valve, and into the annular space 96. The space 96 is of course limited, but is adequate given that precautions are taken to try to exclude all dirt from the bore-hole. Also, in FIG. 8, the O-ring 98 which makes and unmakes the seal between the down-hole fixture and the sample container structure is a component of the sample container structure, which means that its condition may be checked - each time a sample is taken, if need be.

One of the benefits of the new system as described is that samples can be taken with very little wastage of water. This is useful in cases where the water seeps through the ground only at a very slow rate, and is useful also in cases where it is desired to hake the sample accurately from the area close by the sample pick-up point. Some other types of system for collecting groundwater samples have required a flush-through volume several times greater than the volume of the sample: in the system as described, only a few ccs of the sample are wasted, and cannot be collected. This is useful also when sampling near the surface, or in very shallow aquifers. Also, in the case where the sampled water is polluted, disposing of large volumes of polluted water can be expensive.

Also, in the system as described, the sample travels only a few cm of passageway between the point from which the sample is taken and the sample container. The sample substantially goes straight into the container: there are no long pipes through which the sample has to be transferred. Similarly, for extracting the sample from the ground, transporting the sample, and transferring the sample to the laboratory instruments is all done with a minimum of travel of the sample through pipes. In the system as described, by contrast to some other systems, the sample never comes in contact with a gas.

The sample container and other equipment can be of stainless steel and inert plastics. Thus, there is little danger of substances in the water being lost through sorption into the surroundings. This is important especially when the sample may contain microbiological ingredients.

In some previous systems, the sample entering the sampler collection chamber would be subjected to sudden suction. As mentioned, this can make some volatile components come out of solution from the water. The surge in velocity can cause splashing, which exacerbates the problem. In the new system, the sample can be caused to enter the sample chamber very slowly, which does not displace micro-organisms, clay and silt particles. The sample can be taken at a velocity which does not increase the velocity of the groundwater around the sampling point.

On the other hand, it is not essential that the new system be used only to take small, slow, samples. The system can be used in the case where the sample is pumped and piped to the surface. The system can also be used for injecting water, or other fluids, into the ground.

The systems as described are simple and reliable. All operations can be performed using light hand equipment. Sampling can be performed without energy from external sources.

In summary, the new system is very useful for groundwater sampling for pollution control, scientific sampling, and for in-situ experiments, because:

the wasted volume when taking a sample is very small;

there is only a minimal contact between the sampling equipment and the sample;

the sample does not contact any gases;

the pressure on the sample is maintained during sampling;

the samples can be taken very slowly (or quickly, if that should be required);

the equipment is simple and flexible in operation, and reliable;

the equipment is highly suitable for the task of taking regular readings from a number of sampling locations over a long period of time.

We claim:

1. System for accessing liquid in a borehole, comprising: a lowerable structure; a push/pull structure; and a down-hole fixture, wherein:

the lowerable structure is lowerable into, and removable from, the bore-hole;

the push/pull structure extends, when the lowerable structure is in the borehole, from the lowerable structure up to the ground surface;

the push/pull structure is attached to the lowerable structure, and comprises a means by which the lowerable structure may, from the surface, be raised and lowered in the bore-hole;

the push/pull structure has such structural rigidity, and is of such a nature that a downwards pushing force may be transmitted therethrough from the surface to the lowerable structure, whereby the lowerable structure, when in the borehole, may be forcefully pushed downwards and moved downwards by a force exerted at the ground surface;

the lowerable structure includes a lowerable-structure passageway which is so arranged that a sample of the liquid may be transferred therethrough;

the lowerable structure includes a means for closing the lowerable-structure passageway, when the lowerable structure is being raised in the borehole;

the down-hole fixture remains in the borehole, and open to the liquid surrounding the bore-hole;

the down-hole fixture includes a down-hole passageway leading into the borehole;

the down-hole fixture includes a mechanically-operable check-valve, which is effective normally to hold the down-hole passageway closed, but which, when operated, is effective to hold the down-hole passageway open;

the lowerable structure includes a means for mechanically operating the check-valve, which is effective to operate the check-valve when the lowerable structure is being pushed down, by the push/pull structure, into mechanical engagement with the down-hole fixture, the lowerable structure is engageable mechanically with the down-hole fixture, the nature of the engagement being such that, when so engaged, the passageways are in communication, whereby water may pass via the lowerable-structure passageway and the down-hole passageway between the down-hole fixture and the lowerable structure.

2. System for taking samples of liquid from a bore-hole, comprising: a sample-container structure; a push/pull structure; end a down-hole fixture, wherein:

the sample-container structure is lowerable into, and removable from, the bore-hole;

the push/pull structure extends, when the sample-container structure is in the borehole, from the sample-container structure up to the ground surface;

the push/pull structure is attached to the sample-container structure, and comprises a means by which the sample-container structure may, from the surface, be raised and lowered in the bore-hole;

the push/pull structure has such structural rigidity, end is of such a nature that a downwards pushing force can be transmitted therethrough from the surface to the sample-container structure, whereby the sample-container structure, when in the borehole, may be forcefully pushed downwards and moved downwards by a force exerted at the ground surface;

the sample-container structure includes a chamber which is suitable for receiving and storing a sample volume of the liquid from the bore-hole;

the sample-container structure includes a sample-container passageway which is so arranged that a sample of the liquid may be received therethrough, into the chamber;

the sample-container structure includes a means for closing the sample-container passageway, when the sample-container structure is being raised in the borehole, thereby retaining the sample, in the chamber;

the down-hole fixture remains in the borehole, and includes a reservoir, which is open to the liquid surrounding the bore-hole, and which is effective to contain a volume of the aforesaid liquid;

the down-hole fixture includes a down-hole passageway leading from the reservoir into the borehole;

the down-hole fixture includes a mechanically-operable check-valve, which is effective normally to hold the down-hole passageway closed, but which, when operated, is effective to hold the down-hole passageway open;

the sample-container structure includes a means for mechanically operating the check-valve, which is effective to operate the check-valve when the sample-container structure is being pushed down, by the push/pull structure, into mechanical engagement with the down-hole fixture, the sample-container structure is engageable mechanically with the down-hole fixture, the nature of the engagement being such that, when so engaged, the passageways are in communication, whereby water may pass via the sample-container passageway and the down-hole passageway from the reservoir in the down-hole fixture into the chamber in the sample-container structure.

3. System of claim 2, wherein the system includes an operable sealing means, which is operable when the sample-container structure is in engagement with the down-hole fixture; and, when operated, the sealing means is effective to seal the sample-container passageway to the down-hole passageway.

4. System of claim 3, wherein the nature of the engagement of the sample-container structure with the down-hole fixture is such that, as the sample-container structure and the down-hole fixture are pushed into engagement, the sealing means is operated sealing the passageways from the bore-hole, before the check valve is operated allowing water to pass from the down-hole passageway into the sample-container passageway.

5. System of claim 4, wherein the two passageways comprise respective tubes, and the tubes are arranged co-axially, when the structure and the fixture are in engagement, and are arranged for sealing with respect to each other.

6. System of claim 5, wherein the two tubes are arranged one inside the other, and the seal is arranged between the two tubes.

7. System of claim 5, wherein a stem is provided, which lies inside the tubes, and which is so dimensioned and arranged as to be effective to mechanically unseat the mechanically operable check-valve in the down-hole fixture.

8. System of claim 2, wherein:

the means for closing the sample-container passageway comprises a sample-container-check-valve;

the check valve in the down-hole fixture includes a moveable valve-member which is spring-biassed upwards, and the sample container check-valve includes a moveable valve-member which is spring-biassed downwards;

the system includes a stem, which is positioned to act between the two valve-members, and to be effective to unseat both valve members when the sample-container structure is pushed down into engagement with the down-hole fixture.

9. System of claim 2, wherein:

the sample-container structure is provided with a movable piston;

the system includes an operable piston-raising means, which is operable from the ground surface;

the piston-raising means is effective, when operated, to raise the piston upwards, in the sample-container, while the sample-container structure remains stationary in the borehole, and thereby to create a suction in the sample-container structure for drawing a sample of water into the sample-container.

10. System of claim 2, wherein:

the borehole is defined by a borehole wall structure, which is present in the ground;

the system includes an operable locking means, which is effective, when operated, to lock the sample-container structure with respect to the borehole wall structure; the locking means is operable from the ground surface.

11. System of claim 10, wherein:

the borehole is defined by a borehole wall structure, which is present in the ground;

the system includes an operable locking means, which is effective, when operated, to lock the sample-container structure with respect to the borehole wall structure;

the locking means is operable from the ground surface;

the locking means is operable in conjunction with the operation of the piston-raising means, to the extent that the piston raising means is operable to raise the piston in the sample container while the sample container is locked to the borehole wall structure.

* * * * *